United States Patent [19]

Kind et al.

[11] Patent Number: 4,640,035

[45] Date of Patent: Feb. 3, 1987

[54] IDENTIFYING MEANS

[75] Inventors: Stuart S. Kind, Harrogate; David G. Sanger, Baughurst; John D. Twibell, Ashford Hill, Nr. Newbury; John Hargraves, Newbury, all of England

[73] Assignee: The Secretary of State for Defence in Her Britannic Majesty's Government of the United Kingdom of Great Britain and Northern Ireland, London, England

[21] Appl. No.: 409,025

[22] Filed: Aug. 18, 1982

[30] Foreign Application Priority Data

Sep. 3, 1981 [GB] United Kingdom ..... 8126733

[51] Int. Cl.[4] ..... G09F 3/02

[52] U.S. Cl. ..... 40/625; 40/326; 252/301.16; 252/965

[58] Field of Search ..... 283/114; 428/916; 206/424; 40/625, 327, 316, 326; 252/965, 301.16

[56] References Cited

U.S. PATENT DOCUMENTS

| | | | |
|---|---|---|---|
| 951,147 | 3/1910 | Porter | 40/316 |
| 1,216,964 | 2/1917 | Dodge | 40/316 |
| 1,738,316 | 12/1929 | Reber | 40/316 |
| 1,787,995 | 1/1931 | Reilly | 40/326 |
| 1,822,098 | 9/1931 | Huntress | 40/316 |
| 1,950,126 | 3/1934 | Staples | 40/316 |
| 3,964,294 | 6/1971 | Shair et al. | 436/56 |
| 4,197,104 | 4/1980 | Krystyniak et al. | 252/965 |
| 4,198,307 | 4/1980 | Berkowitz | 149/123 |
| 4,390,452 | 1/1983 | Stevens | 252/408.1 |

FOREIGN PATENT DOCUMENTS

| | | | |
|---|---|---|---|
| 1536192 | 12/1978 | United Kingdom | 40/625 |
| 1568699 | 6/1980 | United Kingdom | 40/625 |

*Primary Examiner*—Gene Mancene
*Assistant Examiner*—Wenceslao J. Contreras
*Attorney, Agent, or Firm*—William R. Hinds

[57] ABSTRACT

A particulate coding material, e.g. for identifying the origin of a product by introducing it at source without its presence being readily apparent, comprises particles formed as thin transverse sections of an assembly of elongated elements, e.g. of plastic or natural fibres, of different colors and/or compositions forming a transversely united structure, e.g. having their longitudinal surfaces in adherent contact or contained in a matrix. The assembly can be produced by combining pre-existing filaments, e.g. by twisting, or by extrusion through a die, and may be drawn-down to a desired size (e.g. 10–150 μm across) before sectioning. The resulting plurality of distinguishable areas in each particle (and, if desired, their relative locations) provide a coding facility. Larger flat bodies similarly formed, and the unsectioned elongated assemblies, also have identifying uses.

15 Claims, 8 Drawing Figures

IDENTIFYING MEANS

This invention relates to identifying means and relates particularly but not exclusively to coding materials formed as fine particles which may be incorporated in products in order to identify their source without their presence in the product being readily apparent.

In British Pat. No. 1,399,551 the need for and use of such particulate coding materials is discussed, and there is disclosed a material for this purpose consisting of dyed Lycopodium spores, suitably of 300 mesh size (i.e. not exceeding 53 μm in diameter). Batches of the spores are dyed different colours and mixed in specific proportions, a small amount of the resulting mixture being added to the product at source. The source of the product can subsequently be identified by microscopic examination of the included spores, whose colours and/or their relative proportions will be specific to that source. Another such material comprises microscopic plastic flakes composed of several distinct coloured layers, the layer colours and sequences being variable to provide different colour codes; this material is obtainable from the 3M Company (U.S.) as "Microtaggant" Particles.

A disadvantage of the dyed spores is that, in use, a small amount of the product in which they are incorporated may contain very few, or even a single spore, so that the original colour coding is not observable. Ideally each identifying particle should incorporate the coding, so that in the ultimate only one particle need be observed to identify the source of the product. The 3M's material does this, but is obtainable only in batches which are too large for many applications; for many purposes only small batches are required, together with the ability to change the coding easily between batches.

The present invention provides in particular forms of coding material which allow the above-described disadvantages to be alleviated, but the invention also has more general application.

According to the present invention, there is provided identifying means comprising flat bodies formed as transverse sections of an elongated body whereof the cross-section includes a characterising feature which extends lengthwise along the elongated body.

The characterising feature may comprise a mark, symbol, letter, number, or the like, or a combination thereof, which extends lengthwise in the manner of the lettering in a stick of rock (the well-known seaside confection).

Alternatively the characterising feature may comprise areas of at least two different colours and/or compositions which extend lengthwise along the elongated body, to provide a coding facility: these areas may or may not occupy the same relative positions in each flat body, depending upon whether their relative positions remain constant or change as they extend along the elongated body.

Before being transversely sectioned to form the flat bodies, the elongated body may have been drawn down to a reduced cross-section from a larger one as which it was produced.

Such flat bodies may be used, for example, as identifying discs or membranes for detecting if a sealed item has been tampered with, e.g. for such applications as sealing over keyholes, since they are not easily repaired or replaced when broken and can readily be changed at intervals for others having different characterising features (like a combination lock).

If made sufficiently small, such flat bodies can provide a particulate coding material. Thus, according to a particular form of the present invention, a particulate coding material comprises particles formed as thin transverse sections of a transversely united assembly comprising longitudinally extending elongated elements of small cross-section, the individual elements being of at least two different colours and/or compositions whereby each section has the same number of areas of each colour and/or composition as every other section.

The elongated elements may have their longitudinal surfaces in adherent contact, one with another, to form said united assembly, or the assembly may comprise the said elements extending with a matrix of further material.

Some or all of the elements and the matrix material may be made of organic plastics material, suitably thermoplastic polymers whereby said adherence between elements, or between elements and matrix, may be provided by fusion of such material. Suitable thermoplastic polymers include, for example, polypropylene and polyethylene. Inorganic plastics and glasses may be also be used, the latter being useful, for example, where high temperatures may be encountered in use which would destroy plastics particles. Non-plastics materials, e.g. natural fibres such as cotton or silk, may also be used.

The elongated elements may be pre-existing filaments which have been combined together to form the assembly. (In this Application the term "filament" includes not only continuous monofilaments, e.g. as formed by extrusion, but also conventional threads made of twisted natural or artificial fibres.) For example the assembly may comprise thermoplastic, inorganic plastic, glass, or natural/artificial-fibre (thread) filaments which have been twisted together, or aligned in contact without twisting, and heated to cause fusion-bonding therebetween, or wetted with a suitable solvent or adhesive to cause adhesion. The filaments may have different cross-sectional dimensions. Cool thin plastic filaments may be applied to the surface of a heated and softened thicker plastic centrefilament to cause adhesion thereto, or dry thin filaments to the solvent-softened or adhesive-wetted surface thereof. Several threads may be twisted round one or more core threads and wetted with an adhesive.

Alternatively the assembly may be formed by co-extrusion of the elongated elements through a die by conventional techniques, using feed materials in either filamentary or molten form. The elements may be extruded as mutually adherent filaments (twisted or otherwise) forming an assembly similar to that produced by e.g. said heating and fusion of pre-existing filaments. The aforesaid matrix form of assembly may be produced by feeding filaments of relatively high meltingpoint to a cross-head extruder fed with a matrix material of relatively low meltingpoint.

Extrusion may also be used to produce forms of elongated assembly in which the elements are constituted by coaxial tubes, or by layers. Another way of forming a coaxial assembly is by repetitively dipping a core in different hardenable liquid materials, suitably molten thermoplastics or lacquers, to build-up the assembly.

However initially formed, the assembly of elongated elements of suitable materials may be drawn-down to a desired reduced cross-section before being transversely sectioned to form said particles. This does not apply, of course, where natural fibres such as cotton or silk threads are incorporated.

The plastics material of some or all of the elements may incorporate dopes, fillers, etc, as well as or instead of dyes, pigments, etc, for the purpose of coding.

The transverse sectioning of the assembly of elongated elements to form the particles, suitably after drawing-down the assembly, can be effected by known methods, e.g. where the assembly is formed by extrusion, die-face or in-line cutting may be used. Alternatively the assembly may be hardened, e.g. by freezing with solid $CO_2$, and/or formed into bundles, for feeding to a guillotine or microtome type of cutter. Temporary "solid" bundles for sectioning may be formed using a temporary adhesive, e.g. PVA, which is afterwards dissolved and the particles filtered off.

The dimensions of the resulting particles are not critical and can be selected in dependence upon their required purpose. Suitably they may be about 10–150 μm across, and of thickness less than their width so that they tend to lie flat.

The relative locations of the several areas within each section formed from the respective elements of the assembly may be constant for all the particles, but this is not essential. Hence, for example, relative displacement of the aforementioned filaments along their lengths is permissible in some embodiments of the invention, e.g. where the identifying code is simply the number of areas of respective colours, irrespective of their relative locations in the particle.

The pattern of the different areas within each section may take different forms, and the structure of the assembly from which they are sectioned is selected accordingly. For example a "daisy-head" pattern may be produced by sectioning an assembly constituted by a core filament of relatively large diameter having filaments of smaller diameter and, for example, of different colours, adherent to its periphery. An assembly of filaments all of similar cross-section will produce a pattern of similar abutting areas of, for example, different colours. Sections from a coaxial assembly will produce a coaxial pattern, and so on.

In addition to their use in forming particulate coding material by transverse sectioning, an assembly of elongated elements as aforesaid, if necessary after drawing-down to appropriate cross-section, may itself be used for identifying purposes e.g. by incorporation in textiles, electric cables, cordage, security seals, etc. The present invention further includes such assemblies of elongated elements usable for such purposes, and similarly includes elongated bodies, usable for such purposes, whereof the cross-section comprises a mark, symbol, letter, number, or the like, or a combination thereof, as aforesaid.

Although the foregoing production methods and forms of elongated assembly have been described in relation to particulate coding materials, they are also applicable generally to identifying means comprising flat bodies in accordance with the present invention.

The present invention also includes methods of producing flat bodies and particulate and elongated coding material as aforesaid, and further includes methods of identifying materials by incorporating therein particulate coding materials or assemblies of elongated elements as aforesaid.

Also according to the present invention, a particulate coding material comprises particles formed as thin substantially flat bodies each comprising areas, either abutting or within a matrix, which are of at least two different colours and/or compositions, each body having the same number of areas of each colour and/or composition as every other body.

To enable the nature of the present invention to be more readily understood, attention is drawn, by way of example, to the accompanying drawings wherein.

Figure 1:
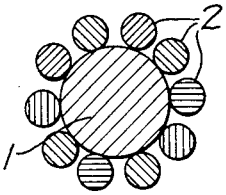
FIG. 1 is a plan view of a particle embodying the invention, showing one suitable pattern of areas of different colours.

FIG. 1 shows a particle of "daisy-head" pattern comprising a central disc 1 of plastics material to whose periphery are attached a plurality of smaller discs 2 of plastics material (ten discs 2 in this example), forming as it were the "petals" of a daisy-head. The discs 2 can be two or more different colours, so that variation of these colours, together with, if desired, their relative locations around the periphery of disc 1, provide a very large number of unique arrangements and hence a coding facility. Suitably the colours used are those of the well-known resistor colour code.

Figure 2:
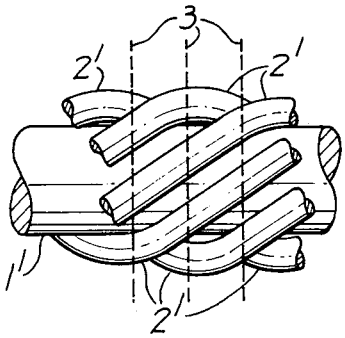
FIG. 2 is an elevation of part of an assembly of twisted, fused, thermoplastic filaments from which the particle of FIG. 1 is obtained by transverse sectioning.
Figure 3:
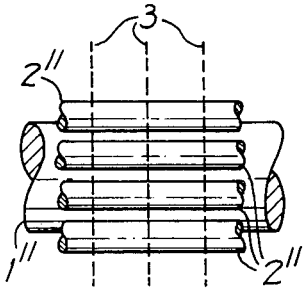
FIG. 3 is an elevation similar to FIG. 2 but of non-twisted filaments.

FIG. 2 illustrates one method of forming the particles of FIG. 1. A central core filament 1' has twisted round it ten smaller filaments 2' adhering to its surface. Such an assembly can be produced by twisting together pre-existing filaments made of a thermoplastic polymer, such as polyethylene or polypropylene, using conventional spinning techniques, and applying heat to cause bonding between adjacent filaments, e.g. by passing the twisted filaments through a heated chamber to cause fusion-bonding, or by applying a suitable solvent. Such filaments are already known for use in making e.g. plastic textiles. The assembly is then sectioned transversely along the lines 3, using e.g. one of the aforementioned cutting techniques, thereby forming particles whose faces have the appearance of FIG. 1. In FIG. 2 the angle of twist of the filaments 2' is exaggerated for clarity; in practice the amount of twist between opposite faces of the particles may be quite small. Instead of spinning, the filaments can be assembled side-by-side without twisting, as shown in FIG. 3, and bonded together by passing through a die which is heated or fed with a suitable solvent or adhesive.

Alternatively the filaments 2' or 2'' can be applied ot the thermally-softened, solvent-softened or adhesive-wetted surface of the larger centre filament 1' or 1''. In the thermally-softened case, this can be done as the filament 1' or 1'' is extruded hot from the die during its forming from the melt, or it can be reheated subsequent to forming. A twisted assembly (FIG. 2) can be thus produced by rotating a set of bobbins carrying the filaments 2' around the axially moving filament 1', as known in the cable-forming art.

As a modification, the filaments 1, 1'' and 2, 2'' need not be plastics monofilaments as shown, but can be conventional threads of twisted fibres (the latter being coloured artificial (plastic) fibres or dyed natural fibres) and the whole being bonded together by wetting with a suitable adhesive such as Araldite or a polyurethane varnish.

Although the dimensions are not critical, the disc 1 may be, for example, 30 μm in diameter and the discs 2 10 μm in diameter, giving an overall diameter of 50 μm. Suitably the particles have a thickness smaller than their diameter, e.g. 10–20 μm in this example.

Where the desired particle diameter is less than that of readily available filaments, or where for ease of manufacture it is desired to use thicker filaments in the assembly-forming process, the assemblies of FIGS. 2 and 3 (unless they include natural fibres) can be produced by drawing-down corresponding assemblies of larger cross-section, again using conventional techniques, e.g. by passing the bonded filaments through a heated chamber under tension. This step may be combined with the bonding step.

The individual filaments need not be circular in cross-section as shown in FIGS. 1, 2 and 3. Indeed these Figures are idealised, in that the steps of forming and sectioning the assembly will usually produce some distortion of initially circular filaments.

Although in FIGS. 1, 2 and 3 the filaments 2', 2'' are shown occupying constant relative positions around filaments 1', 1'', this is not essential in some forms of coding, notably where only the numbers of discs of different colours, rather than their relative locations, signify. It will also be seen that not all the filaments 2', 2'', need be of different colours. Codes in which two or more discs 2 have the same colour can be used.

Other methods of forming the particles of FIG. 1 may be used, e.g. by conventional co-extrusion of a corresponding twisted or untwisted assembly through a suitable die using feed materials of different colours, followed by transverse sectioning as for FIGS. 2 and 3. The feed material to the die can be either preexisting plastics filaments or molten material, as is known in the plastic-extrusion art. Die-face cutting of the extruded assembly, in-line rotary cutting or other known cutting techniques, can be used to form the particles.

Figure 4:
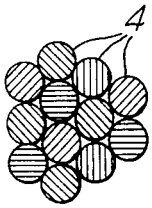
FIGS. 4, 5, 6 and 7 are plan views of other particles embodying the invention, showing alternative patterns of differently coloured areas from that of FIG. 1.

In the form of particle shown in FIG. 4 there is no large disc, but a plurality of twelve similar small discs 4 which adhere together. Such particles can be made by bonding twelve similar filaments (monofilaments or threads or a mixture thereof) together as described in relation to FIGS. 2 and 3, or by extrusion. In this case also an assembly of the desired size for sectioning can be produced by drawing-down an initial assembly of appropriate materials. Using threads, the assembly for sectioning is conveniently made by twisting a plurality of threads under tension around a stationary core thread or threads also under tension, and wetting with a suitable adhesive. Similarly, two or more filaments can be of the same colour, and the relative locations of the filaments, and hence of the resulting discs 4, may or may not remain constant from particle to particle. The circularity of the discs 4 in FIG. 4 is again idealised.

Figure 5:
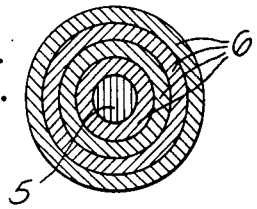
Figure 6:
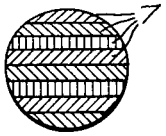

The particle shown in FIG. 5 comprises a central area 5 and four annular areas 6 of different colours. An assembly of elongated coaxial elements from which such particles are sectioned may be formed by co-extrusion through a die, or by repetitively dipping a core in different hardenable molten plastics or lacquers of different colours to build-up the coaxial assembly. Again, drawing-down may be employed to obtain a suitable size. In FIG. 6 the different coloured areas 7 form parallel strips; such particles can be formed by sectioning a corresponding co-extruded elongated assembly. Although shown circular, such particles as those of FIGS. 5 and 6 may have other peripheral shapes, e.g. approximately square.

Figure 7:
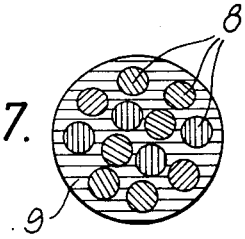

The particle shown in FIG. 7 comprises twelve small discs 8 of two or more different colours within a matrix 9 of a further colour. Such particles can be made by sectioning an assembly formed by feeding corresponding filaments 8' (not shown), made of a relatively high melting-point plastic, to a cross-head extruder fed with a matrix material which is a relatively low melting-point plastic. Again the relative locations of the filaments 8' may or may not remain constant along the resultant assembly, depending on whether or not the relative locations of the discs 8 is to be significant in the coding system.

The twisted-filament method of assembly production (FIG. 2) is well adapted to small-batch production of particles by individual users, and may therefore be preferred for some purposes.

Figure 8:
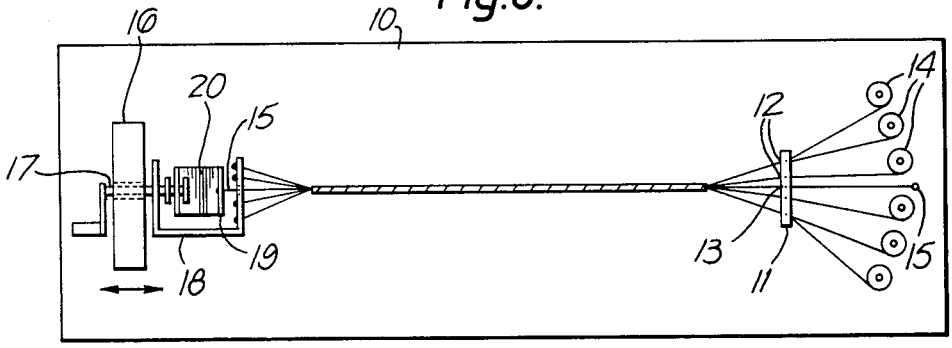
FIG. 8 is a plan view of apparatus for use in producing particles.

FIG. 8 is a plan view of a simple apparatus for use in producing multi-coloured coding particles from twisted coloured threads, e.g. of cotton, silk or artificial fibres. At one end of a base 10 is mounted a vertical plate 11 provided with six guide-holes 12 surrounding a central hole 13. Six bobbins 14 carrying the different coloured threads are mounted on spindles and provided with simple friction brakes (not shown) to maintain tension on the threads, which pass from each bobbin through a respective hole 12. A core thread fixed to a pin 15 passes through hole 13.

At the other end of base 10 a vertical plate 16 carries a shaft 17 having a cranked handle. To shaft 17 is secured a U-member 18 to which are secured the ends of the threads from bobbins 14 in a similar pattern to guide-holes 12. The core thread passes through a hole in member 18 and is secured to a second U-member 19 which is free to turn on shaft 17. Member 19 includes a weight 20 which prevents member 19 (and hence the core thread) from rotating as member 18 is rotated by the handle to twist the bobbin threads round the core thread. Plate 16 is movable in the direction of the arrow to adjust the tension as twisting proceeds.

Thereafter, the twisted threads can be wetted with an adhesive, such as Araldite, contained in a hollow slotted cone whose narrow end is a reasonable close fit around the twisted threads and which is slid to and fro along them. The wetted threads are then severed and hung up to dry under weighted tension before sectioning, using e.g. a microtome type of cutter.

Although the use of thermoplastic organic plastics is particularly suitable, other materials are not excluded, notably inorganic plastics or glasses, the latter being useful for example where high temperatures may be encountered in use, e.g. to incorporate in explosives to allow identification after detonation. In any case the plastic material used must be compatible with the material or product in which it is to be incorporated, e.g. it must not be soluble therein or otherwise suffer such degradation in use as to render the particles incapable of identification.

Other uses of particulate coding material according to the present invention include the provision of edible but non-digestible particles, e.g. made from filaments coloured with permitted food-colouring substances, for e.g. the quality control of food products for humans and animals. They may also be incorporated in drugs and pharmaceuticals to allow rapid identification in the emergency treatment of overdoses.

We claim:

1. A particulate coding material comprising particles formed as thin transverse sections of an assembly comprising preexisting filaments twisted together and having their longitudinal surfaces in adherent contact, one with another, the individual filaments being of at least two different colors and/or compositions whereby each section has the same number of areas of each color and/or composition as every other section, wherein prior to sectioning into thin transverse sections the filaments of the assembly are transversely united only by the twist and the adherent contact, and, after sectioning, the filament sections of the particles are permanently transversely united only by said adherent contact, and wherein the assembly and the resulting particles are devoid of any surrounding cover about their exteriors.

2. Material as claimed in claim 1 wherein the assembly comprises filaments twisted around at least one core filament.

3. Material as claimed in claim 2 comprising thinner filaments adherent to a core formed by a thicker filament.

4. Material as claimed in claim 3 formed by a process comprising the step of applying the thin filaments to the heat-softened, solvent-softened or adhesive-wetted surface of the thicker core filament to effect adhesion thereto.

5. Material as claimed in claim 1 or claim 2 formed by a process comprising the step of applying a liquid adhesive to the filaments to effect adherence therebetween.

6. Material as claimed in claim 5 wherein said adhesive is applied to the filaments after the filaments are twisted together.

7. Material as claimed in claim 1 or claim 2 wherein at least some of the filaments are made of organic plastics material.

8. Material as claimed in claim 1 or claim 2 wherein at least some of the filaments are made of inorganic plastics material or of glass.

9. Material as claimed in claim 1 or claim 2 wherein at least some of the filaments are natural fibres.

10. Material as claimed in claim 7 wherein the organic plastics material is thermoplastic polymer material and wherein adherence between adjacent filaments is by fusion of said polymer material.

11. Material as claimed in claim 10 wherein the assembly is drawn-down to a reduced cross-section from a larger one as which it is initially produced before being transversely sectioned to form said particles.

12. Material as claimed in claim 1 or 2 wherein the particles have a width in the range 10–150 μm and a thickness less than their width.

13. Material as claimed in claim 1 or 2 wherein the relative locations of the several areas within each section formed from the respective filaments of the assembly are constant for all the particles.

14. A method of identifying a product by incorporating therein particulate coding material as claimed in claim 1 or 2.

15. A particulate coding material as claimed in claim 1 wherein all of said filaments are nonmetallic.

* * * * *